US009068728B1

(12) United States Patent
Lee

(10) Patent No.: US 9,068,728 B1
(45) Date of Patent: Jun. 30, 2015

(54) LIGHTING DEVICE WITH CONVERTING MECHANISM

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 45 days.

(21) Appl. No.: 14/156,391

(22) Filed: Jan. 15, 2014

(51) Int. Cl.

| | |
|---|---|
| ***F21V 14/08*** | (2006.01) |
| ***F21V 9/10*** | (2006.01) |
| *F21Y 101/02* | (2006.01) |
| *F21W 131/402* | (2006.01) |
| *F21W 131/10* | (2006.01) |
| *F21V 1/00* | (2006.01) |

(52) U.S. Cl.
CPC ..... *F21V 14/085* (2013.01); *F21V 9/10* (2013.01); *F21Y 2101/02* (2013.01); *F21W 2131/402* (2013.01); *F21W 2131/1005* (2013.01); *F21L 15/02* (2013.01)

(58) Field of Classification Search
CPC ..... F21L 15/02
See application file for complete search history.

(56) References Cited

U.S. PATENT DOCUMENTS 5,036,444 A * 7/1991 Hiles ..... 362/188
7,568,812 B1 * 8/2009 Kumthampinij et al. ..... 362/105

* cited by examiner

*Primary Examiner* — Mary Ellen Bowman

(57) ABSTRACT

A lighting device with converting mechanism includes a main body and a lens assembly. The main body has an illuminant portion at one side thereof. The illuminant portion has a light emitting diode. The lens assembly is mounted to the illuminant portion. The lens assembly has a fog lens, an inner ring and an outer ring. The fog lens is pivotally connected to the illuminant portion. The inner ring is attached to the illuminant portion and configured to drive the fog lens to rotate. The outer ring is mounted around the inner ring and configured to drive the inner ring to rotate. Under this arrangement, the fog lens is pivotable between a first position in which the fog lens covers the light emitting diode to form a fog light and a second position in which the fog lens uncovers the light emitting diode.

7 Claims, 7 Drawing Sheets

LIGHTING DEVICE WITH CONVERTING MECHANISM

BACKGROUND OF THE INVENTION

1. Field of the Invention

The present invention relates to a lighting device, and more particularly to a lighting device with converting mechanism which is configured to change a light model of the lighting device.

2. Description of Related Art

A headlamp is a lighting device affixed to the head for works or outdoor activities at night or in dark conditions such as caving, forest or tunnel. Headlamps are often used by workers in underground mining, and by automotive mechanics, building superintendents, electricians, and other maintenance workers who need hands-free lighting when working in poor light locations.

The simplest headlamp is a lighting device attached to a fastener strap or other objects. However, this simple design can only provide an illumination within a certain range because the lens of the flashlight is immovable. If a worker wants to increase the illuminating range or a miner wants to spotlight the mines, the simplest design cannot achieve these requirements.

A conventional lighting device with adjusting mechanism comprises a base and an illumination module assembled to the base. The worker can rotate a case of the illumination module to move the case back and forth relative to the base to adjust the illuminating range, while the lens of the illumination module is moving backward or forward to increase or spotlight the illuminating range. However, the conventional lighting device does not have fog light, and therefore could not be used in conditions of poor visibility due to rain, fog, dust or snow.

The present invention has arisen to mitigate and/or obviate the disadvantages of the conventional lighting device.

SUMMARY OF THE INVENTION

The main objective of the present invention is to provide an improved lighting device with converting mechanism.

To achieve the objective, a lighting device comprises a main body and a lens. The main body has an illuminant portion defined at one side thereof and a light emitting diode disposed at the illuminant portion of the main body. The lens assembly is mounted to the illuminant portion of the main body. The lens assembly has a fog lens, an inner ring and an outer ring. The fog is lens pivotally connected to the illuminant portion of the main body and corresponds to the light emitting diode. The inner ring is attached to the illuminant portion of the main body and configured to drive the fog lens to rotate relative to the illuminant portion. Furthermore, the outer ring is mounted around the inner ring and configured to drive the inner ring to rotate.

Specifically, the inner ring is formed with a protrusion on an inner periphery thereof. The fog lens has a lid portion and a driven portion. The lid portion of the fog lens corresponds to the light emitting diode. The driven portion of the fog lens has an inclined slot for accommodating the protrusion of the inner ring such that horizontal movement of the protrusion can cause the fog lens to move pivotally.

Under this arrangement, the fog lens is pivotable between a first position in which the fog lens substantially covers the light emitting diode to form a fog light and a second position in which the fog lens uncovers the light emitting diode.

Further benefits and advantages of the present invention will become apparent after a careful reading of the detailed description with appropriate reference to the accompanying drawings.

DETAILED DESCRIPTION OF THE INVENTION

Figure 1:
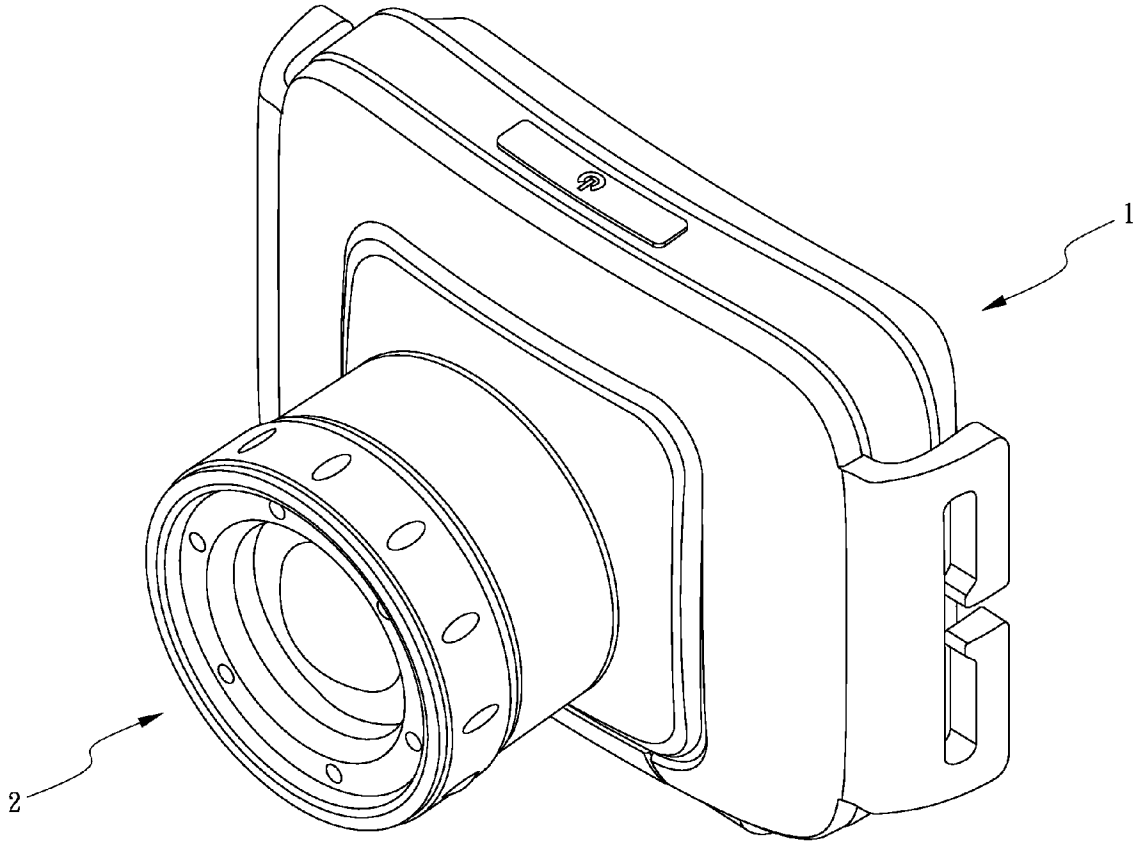
FIG. 1 is a perspective view of a lighting device with converting mechanism of the present invention.
Figure 2:
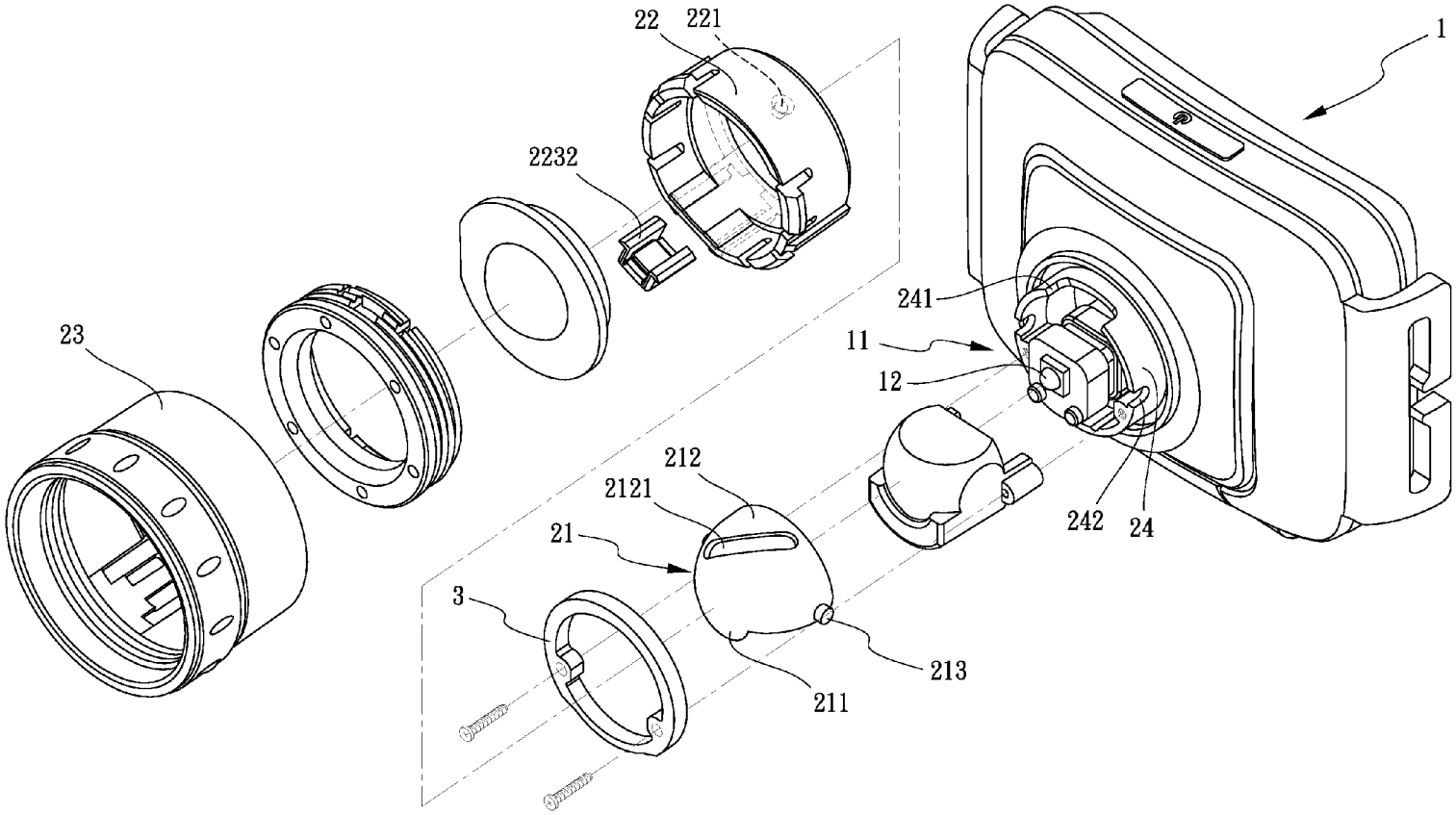
FIG. 2 is an exploded perspective view of the lighting device with converting mechanism of FIG. 1.
Figure 3:
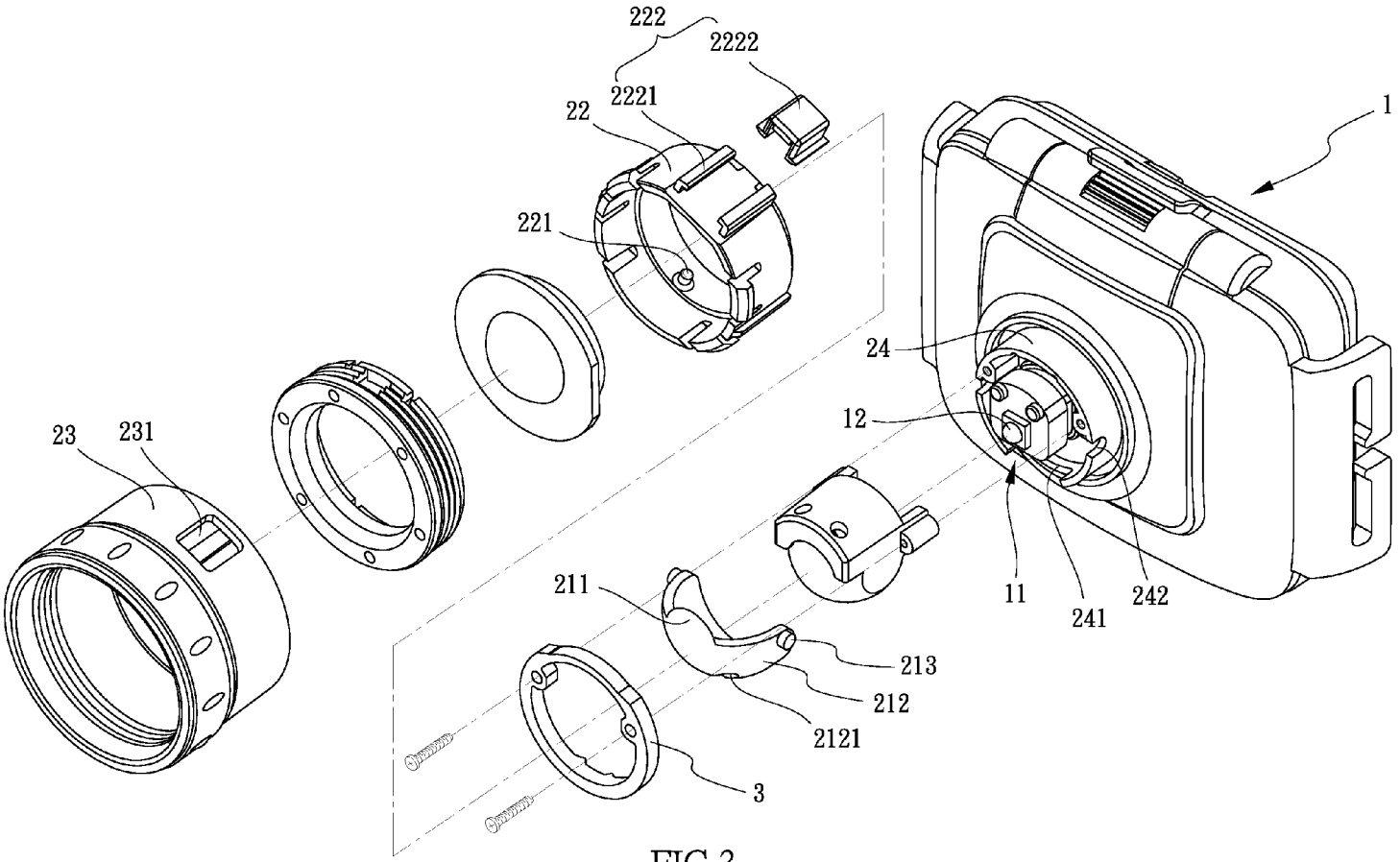
FIG. 3 is another exploded perspective view of the lighting device with converting mechanism of FIG. 1 taken from another angle.

Referring to FIGS. 1-3, a lighting device with converting mechanism in accordance with a preferred embodiment of the present invention comprises a main body 1 and a lens assembly 2. The main body 1 has an illuminant portion 11 defined at one side thereof. A light emitting diode 12 is disposed at the illuminant portion 11 of the main body 1. The lens assembly 2 is mounted to the illuminant portion 11 of the main body 1. The lens assembly 2 has a fog lens 21, an inner ring 22 and an outer ring 23. The fog lens 21 is pivotally connected to the illuminant portion 11 of the main body 1 and corresponding to the light emitting diode 12. The inner ring 22 is attached to the illuminant portion 11 of the main body 1 and configured to drive the fog lens 21 to rotate relative to the illuminant portion 11. The outer ring 23 is mounted around the inner ring 22 and configured to drive the inner ring 22 to rotate simultaneously.

Figure 4:
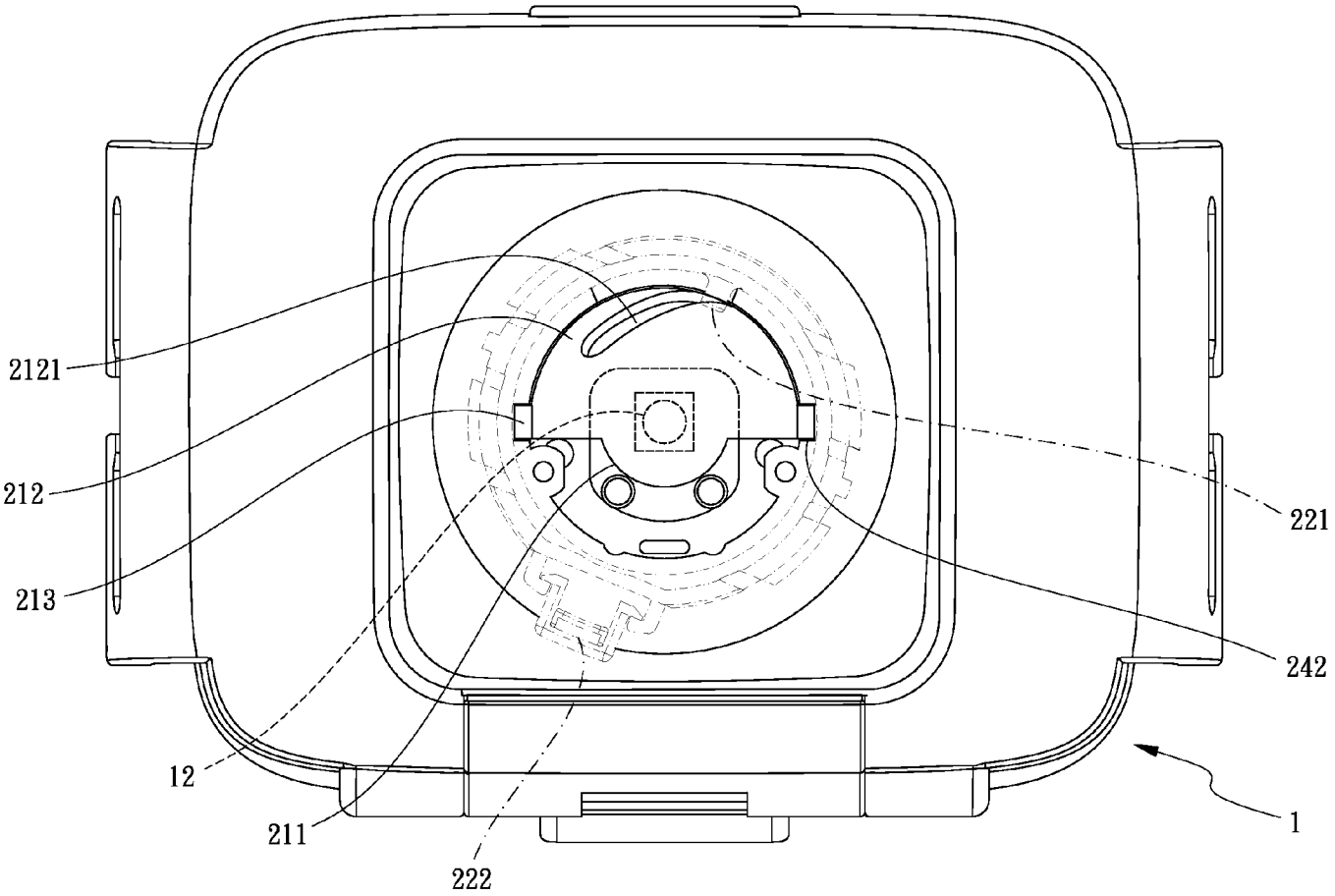
FIGS. 4-5 illustrate that a fog lens is rotated from a first position to a second position.
Figure 5:
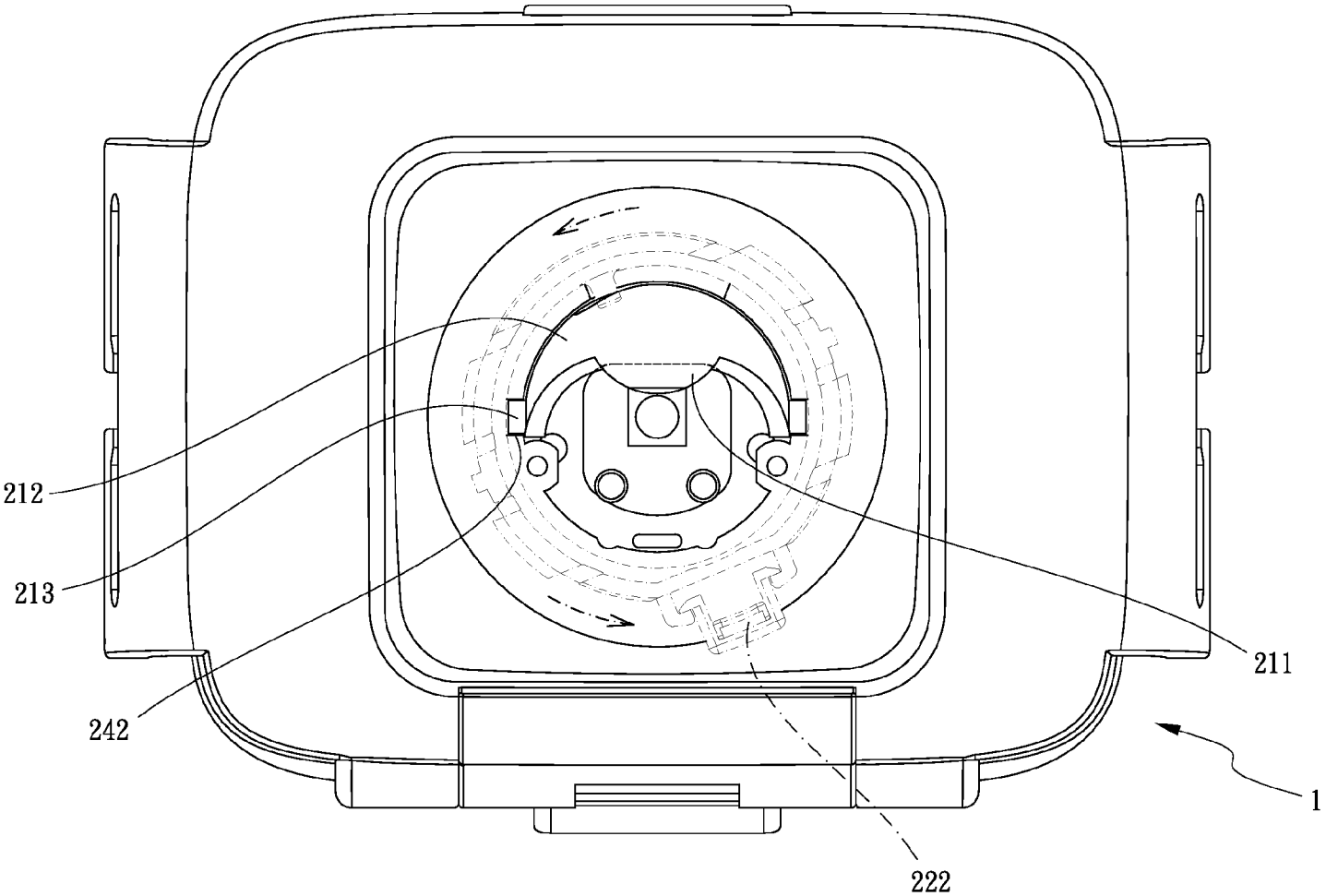

FIGS. 4-5 illustrate the operating process of the lighting device of the present invention, wherein the lighting device could be selectively converted between a normal light model and a fog light model. In the fog light model, as shown in FIG. 4, the fog lens 21 is disposed in a first position where the fog lens 21 substantially covers the light emitting diode 12 so that a light beam of the light emitting diode 12 passes through the fog lens 21 to form a fog light. In the normal light model, as shown in FIG. 5, the fog lens 21 is disposed in a second position where the fog lens 21 uncovers the light emitting diode 12.

Under this arrangement, the fog lens 21 could be pivotable between the first position and the second position by rotating the outer ring 23 to drive the inner ring 22 and further drive the fog lens 21, so that the light device could be converted between the normal light model and the fog light model conveniently. Specifically, the fog lens 21 is an optical filter which selectively transmits light in a particular range of wavelengths for being used in conditions of poor visibility due to rain, fog, dust or snow.

Referring to FIGS. 2-5, the inner ring 22 is formed with a protrusion 221 on an inner periphery thereof. The fog lens 21 has a lid portion 211 and a driven portion 212. The lid portion 211 of the fog lens 21 corresponds to the light emitting diode 12. The driven portion 212 of the fog lens 21 has an inclined slot 2121 for accommodating the protrusion 221 of the inner ring 22 such that horizontal movement of the protrusion 221 can cause the fog lens 21 to move pivotally. As shown in FIG. 4, the fog lens 21 is disposed in the first position wherein the protrusion 221 of the inner ring 22 is positioned in one end of the inclined slot 2121 of the driven portion 212. In contrary, as shown in FIG. 5, the inner ring 22 is rotated reversely and the protrusion 221 of the inner ring 22 is slid to the other end of the inclined slot 2121 of the driven portion 212, and therefore the fog lens 21 is pivoted upwardly to the second position.

Figure 6:
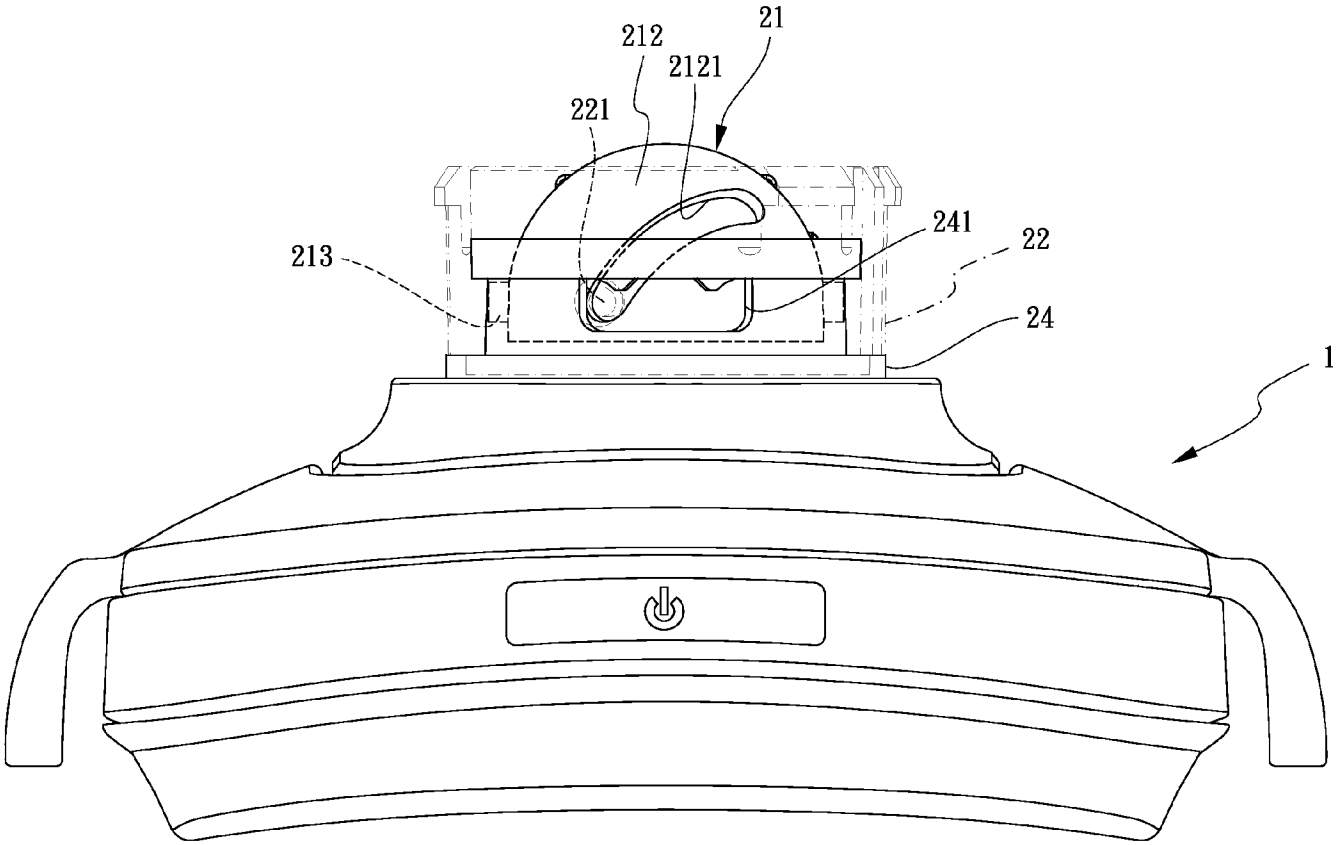
FIGS. 6-7 illustrate that a protrusion of an inner ring is moved from a first portion to a second position of an inclined slot of the fog lens.
Figure 7:
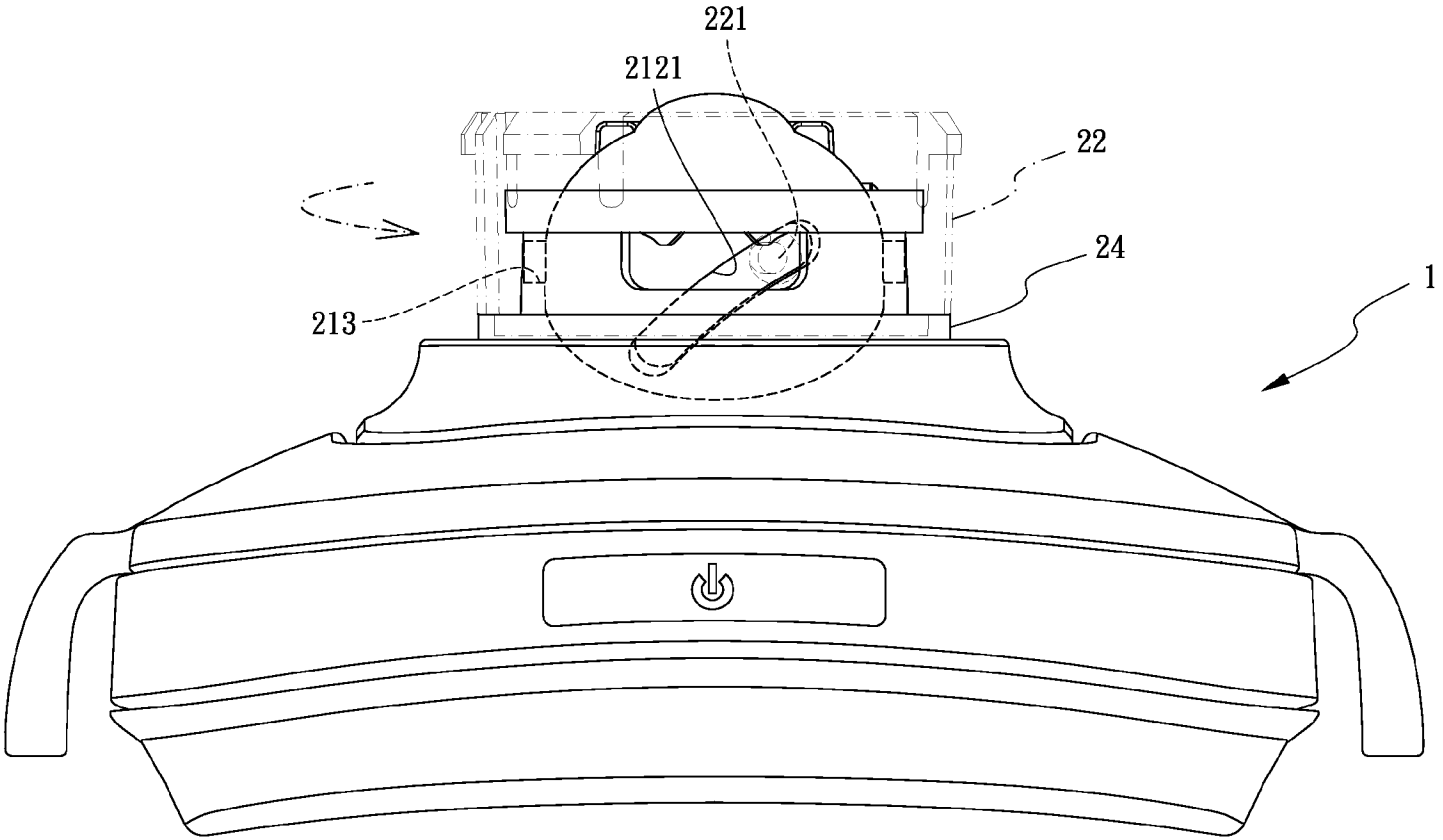

Referring to FIGS. 6-7, the lens assembly 2 further has a base 24 connected to the main body 1 and extending into the inner ring 22. The base 24 defines a retaining cutout 241 at a periphery thereof. The protrusion 221 of the inner ring 22 is horizontally movable within the retaining cutout 241 of the base 24 so as to restrict the protrusion 221 of the inner ring 22 in a certain range.

Referring to FIGS. 2-4, the fog lens 21 is formed with a pair of studs 213 on opposite sides thereof and the base 24 has a pair of pivot slots 242 for accommodating the studs 213 of the fog lens 21. Therefore, the fog lens 21 could be pivotable via the studs 213. Furthermore, the lighting device further comprises a securing ring 3 assembled to the base 24 and sealed the pivot slots 242 of the base 24, wherein the securing ring 3 is disposed around the fog lens 21.

Moreover, as shown in FIGS. 3-5, the outer ring 23 defines a socket 231 in an outer periphery thereof and the inner ring 22 has a connecting member 222 coupled to the socket 231 of the outer ring 23. Specifically, the connecting member 222 of the inner ring 22 has a rail 2221 and a slide block 2222. The slide block 2222 is fitted to the socket 231 of the outer ring 23 and slidably mounted in the slide rail 2221 so as to couple the inner ring 22 and the outer ring 23 together. Therefore, the inner ring 22 could be drove by the outer ring 23.

Although embodiments of this invention have been fully described with reference to the accompanying drawings, it is to be understood that various modifications can be made by those skilled in the art without departing from the scope of the invention as hereinafter claimed.

What is claimed is:

1. A lighting device, comprising:

a main body having an illuminant portion defined at one side thereof and a light emitting diode disposed at the illuminant portion of the main body; and a lens assembly mounted to the illuminant portion of the main body, the lens assembly having a fog lens, an inner ring and an outer ring, the fog lens pivotally connected to the illuminant portion of the main body and corresponding to the light emitting diode, the inner ring attached to the illuminant portion of the main body and configured to drive the fog lens to rotate relative to the illuminant portion, the outer ring mounted around the inner ring and configured to drive the inner ring to rotate;

wherein the fog lens is pivotable between a first position in which the fog lens substantially covers the light emitting diode to form a fog light and a second position in which the fog lens uncovers the light emitting diode.

2. The lighting device as claimed in claim 1, wherein the inner ring is formed with a protrusion on an inner periphery thereof; the fog lens has a lid portion and a driven portion; the lid portion of the fog lens corresponds to the light emitting diode; the driven portion of the fog lens has an inclined slot for accommodating the protrusion of the inner ring such that horizontal movement of the protrusion causes the fog lens to move pivotally.

3. The lighting device as claimed in claim 2, wherein the lens assembly further has a base connected to the main body and extending into the inner ring; the base defines a retaining cutout at a periphery thereof; and the protrusion of the inner ring is horizontally movable within the retaining cutout of the base.

4. The lighting device as claimed in claim 3, wherein the fog lens is formed with a pair of studs on opposite sides thereof; and the base has a pair of pivot slots for accommodating the studs of the fog lens.

5. The lighting device as claimed in claim 4, further comprising a securing ring assembled to the base and sealed the pivot slots of the base; wherein the securing ring is disposed around the fog lens.

6. The lighting device as claimed in claim 1, wherein the outer ring defines a socket in an outer periphery thereof and the inner ring has a connecting member coupled to the socket of the outer ring.

7. The lighting device as claimed in claim 6, wherein the connecting member of the inner ring has a rail and a slide block; the slide block is fitted to the socket of the outer ring and slidably mounted in the slide rail so as to couple the inner ring and the outer ring together.

* * * * *